US010048617B2

(12) United States Patent
Schulkes et al.

(10) Patent No.: US 10,048,617 B2
(45) Date of Patent: Aug. 14, 2018

(54) REFILL ADAPTER FOR COUPLING A TONER BOTTLE TO A TONER RESERVOIR IN A PRINTING SYSTEM AND ASSOCIATED METHOD

(71) Applicant: Océ-Technologies B.V., Venlo (NL)

(72) Inventors: Joseph A. Schulkes, Venlo (NL); Otto W. Salomons, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 156 days.

(21) Appl. No.: 15/354,014

(22) Filed: Nov. 17, 2016

(65) Prior Publication Data

US 2017/0153575 A1 Jun. 1, 2017

(30) Foreign Application Priority Data

Dec. 1, 2015 (EP) ..... 15197373

(51) Int. Cl.
*G03G 15/08* (2006.01)

(52) U.S. Cl.
CPC ..... *G03G 15/0867* (2013.01)

(58) Field of Classification Search
CPC ..... B41J 2/17536; B41J 2/17553; G03G 15/0867–15/0872; G03G 2215/0678
(Continued)

(56) References Cited

U.S. PATENT DOCUMENTS 5,481,344 A * 1/1996 Yasuda ..... G03G 15/087 222/DIG. 1

5,655,179 A * 8/1997 Ueda ..... G03G 15/0881 141/364

(Continued)

FOREIGN PATENT DOCUMENTS

| | | | |
|---|---|---|---|
| EP | 1 233 310 | A2 | 8/2002 |
| WO | WO 2007/093625 | A1 | 8/2007 |
| WO | WO 2013/056986 | A1 | 4/2013 |

*Primary Examiner* — Billy Lactaoen
(74) *Attorney, Agent, or Firm* — Birch, Stewart, Kolasch & Birch, LLP

(57) ABSTRACT

The present invention provides a refill adapter for coupling a closure of a toner bottle to a toner reservoir, the refill adapter comprising: a base having an insertion area for receiving the closure inserted therein and an opening mechanism for opening the closure, wherein the opening mechanism is configured to hold a first closure member of the closure and to move a second closure member of the closure relative to the first closure member along an axis between a closed position, in which the second closure member cooperates with the first closure member to close or seal an outlet opening of the closure, and an open position for dispensing toner from the toner bottle through the outlet opening into the toner reservoir; a sealing device comprising a first sealing part, which is fixed to the base, and a second sealing part, which is movable relative to the first sealing part, wherein the second sealing part is configured to be moved together with the second closure member along the axis and to thereby contact the second closure member for isolating an outer region of the closure from an inner region of the closure, which is in contact with toner. Furthermore, the invention provides a corresponding method of coupling a toner bottle to a toner reservoir, and a printing system comprising such a refill adapter and/or for performing such a method.

20 Claims, 7 Drawing Sheets

(58) Field of Classification Search
USPC ..... 399/260
See application file for complete search history.

(56) References Cited

U.S. PATENT DOCUMENTS

| | | | | |
|---|---|---|---|---|
| 2009/0016770 | A1 | 1/2009 | Pensold et al. | |
| 2014/0255058 | A1* | 9/2014 | Salomons ..... | G03G 15/0894 399/106 |

* cited by examiner

REFILL ADAPTER FOR COUPLING A TONER BOTTLE TO A TONER RESERVOIR IN A PRINTING SYSTEM AND ASSOCIATED METHOD

FIELD OF THE INVENTION

The present invention relates to a refill adapter for coupling a closure of a toner bottle to a toner reservoir and to a method of coupling a toner bottle to a toner reservoir. The invention also relates to a printing system that includes such a refill adapter and to a printing system for performing such a method.

BACKGROUND OF THE INVENTION

In printing or copying systems, and especially in laser-based printing or copying systems, toner refill arrangements are used to refill a toner reservoir of a printer or copier. Toner is therefore filled from a toner bottle, which usually is configured as re-fill bottle, into the toner reservoir.

Therefore, a refill mechanism and a toner bottle closure are provided that permit establishment of a flow communication between an interior of the toner bottle and the toner reservoir without permitting fine toner particles or powder (or alternatively toner liquid) to escape. Further, it should be avoided that toner powder (or toner liquid) remains on the external surfaces of the toner reservoir and the toner bottle when the refill process has been completed.

Another problem is to prevent the creation of toner crust or toner chips, which can form when toner particles or powder adheres to surfaces of the refill mechanism and may come into sliding engagement with one another such that frictional heat causes the toner powder to cake. Such toner crust or toner chips may disturb the toner development process in the printing or copying system if it/they enter the toner reservoir.

The published patent document WO 2013/056986 A1 describes a toner bottle cap of the general type mentioned above.

SUMMARY OF THE INVENTION

In view of the above, an object of the present invention is to provide a new and improved refill adapter for coupling a toner bottle to a toner reservoir and a printing system which includes such a refill adapter.

In accordance with the present invention, a refill adapter for coupling a closure of a toner bottle to a toner reservoir as recited in claim 1, a method of coupling a toner bottle to a toner reservoir as recited in claim 14 and a printing system as recited in claim 15 are provided. Advantageous or preferred features of the invention are recited in the dependent claims.

According to one aspect, therefore, the present invention provides a refill adapter for coupling a closure of a toner bottle to a toner reservoir, where the refill adapter comprises a base having an insertion area for receiving the closure inserted therein and an opening mechanism for opening the closure. The opening mechanism is configured to hold a first closure member of the closure and to move a second closure member of the closure relative to the first closure member. The opening mechanism thereby moves the second closure member along an axis between a closed position and an open position. In the closed position, the second closure member cooperates with the first closure member to close or seal an outlet opening of the closure. In the open position, toner can be dispensed from the toner bottle through the outlet opening into the toner reservoir. The refill adapter also comprises a sealing device or arrangement for preventing toner leakage during operation of the opening mechanism. The sealing device or sealing arrangement comprises a first sealing part, which is fixed to the base, and a second sealing part, which is movable relative to the first sealing part. The second sealing part is configured to be moved with the second closure member along the axis and to contact the second closure member for isolating an outer region of the closure from an inner region of the closure in contact with toner.

In this way, the invention provides a refill adapter which cooperates with a closure of a toner bottle to prevent movement of parts in contact with toner in a direction different from the axis of movement of the second closure member. Because lateral movement of parts of the closure and refill adapter in contact with toner is prevented according to the invention, toner cannot be trapped between those parts and be subject to shearing or frictional rubbing. Thus, toner cannot be exposed to frictional heat caused by lateral movement, which results in prevention of toner powder to cake. Thus, the invention provides a refill adapter which is configured for preventing caking of toner or the creation of toner crust or chips.

Furthermore, the invention provides a refill adapter which, by means of the sealing device or sealing arrangement, is able to isolate of areas of the bottle in contact with toner from clean areas of a user and the environment, even during movement of the second closure member. Thus, unwanted escape or leakage of toner is able to be reliably prevented by the refill adapter.

In a preferred embodiment, the second sealing part is resiliently biased to press and seal against the second closure member. Thus, a reliable seal is provided in the open position, in the closed position and in any intermediate position during movement of the second closure member there-between.

In a preferred embodiment, the sealing device or sealing arrangement comprises a flexible sealing membrane, such as a bellows, one portion of which forms the first sealing part which is fixed to the base and another portion of which forms the second sealing part configured to contact and to seal against the second closure member. In this regard, the membrane may be tubular, with one end region of the tubular membrane forming the first sealing part and an opposite end region of the tubular membrane forming the second sealing part.

In a preferred embodiment, the sealing device further comprises a third sealing part, which interconnects the first sealing part and the second sealing part. In this regard, the third sealing part may form a flexible or deformable sealing channel between the first sealing part and the second sealing part. Where, for example, the sealing device or sealing arrangement comprises a flexible sealing membrane as described above, the third sealing part may comprise an intermediate portion of the membrane between the first and second sealing parts at the opposite end regions thereof. Alternatively or in addition, the third sealing part of the sealing arrangement may be configured to provide the resilient bias of the second sealing part. Thus, the third sealing part advantageously provides multiple functions. It can be formed as an annular spring member with an inner and an outer diameter. For example, the outer diameter is connected to the first part and the inner diameter is connected to the second sealing part such that, in the closed position, when it is extended, the membrane has a form of an outwardly tapering or widening tube.

In a preferred embodiment, the refill adapter includes a support element provided on the base and positioned in the insertion area, and especially centrally in the insertion area. The support element is configured to engage a facing end portion of the first closure member and to support the first closure member when, in operation, the closure is inserted into the insertion area. In this way, a defined abutment is advantageously provided for the first closure member. Thus, the support element is configured to engage the facing end portion of the first closure member in an operating state of the refill adapter, when a closure is inserted in the insertion area. Furthermore, in a non-operating state, when the insertion area is free of any closure, the support element may form part of a closed surface of the insertion area. In this respect, the support element has multiple different functions in the different states of the refill adapter.

In a preferred embodiment, the sealing device and the support element are adapted or configured to fit together for closing a reservoir opening of the toner reservoir in the non-operating state and/or when the closure of the toner bottle is in the closed position. Advantageously, therefore, the reservoir opening may remain securely closed in the non-operating state.

In a preferred embodiment, the support element comprises a flexible fitting part at least at a periphery or an outer edge thereof. The flexible fitting part may have multiple different functions, in particular in the different states of the refill adapter. For example, the flexible fitting part is desirably configured to contact the second sealing part for sealing the reservoir opening in the non-operating state and/or when the closure is in the closed position. Advantageously, a seal is thus provided for the reservoir opening at least in the non-operating state. Alternatively or in addition, the flexible fitting part is configured for contacting the facing end portion of the first closure member for isolating the facing end portion from the inner region of the closure in the operating state and/or when the closure is in the open position. In this way, the facing end portion of the closure can be kept free and clean of toner, such that neither a user nor the environment comes into contact with toner during or after a refilling operation, when the closure is released from the refill adapter.

In a preferred embodiment, the opening mechanism comprises a slider or drawer member which is disposed in the base and movable in a direction substantially normal to the axis of movement of the second closure member between a first position, in which it is retracted into the base, and a second position in which it is at least partially extended out of the base. The slider or drawer member is adapted or configured to entrain the second closure member when it is moved from the first position to the second position.

In a preferred embodiment, the slider or drawer member comprises translation means configured to translate movement of the slider or drawer member into an axial movement of the second closure member. Thus, a bottle closure inserted into the insertion area of the adapter can be manipulated between the closed and open positions by extending and retracting the slider or drawer member, because the movement of the slider or drawer member is translated into an axial movement of the second closure member. In a preferred embodiment, the translation means comprises guide grooves extending along the slider or drawer member, especially along an inner surface of the slider or drawer member interfacing with the insertion area. Outwardly projecting cam or follower elements provided on opposite sides of the second closure member engage with these grooves in the insertion area to translate the movement. In an alternative embodiment, it is conceivable that the second closure member could be provided with guide grooves and the slider or drawer member provided with inwardly extending cam or follower elements.

Advantageously, the slider or drawer member is not in contact with toner, as the sealing device in cooperation with the closure isolates the slider or drawer member from the inner region of the closure. Toner therefore cannot collect or be trapped between the slider or drawer member and the base, which in turn avoids creation of toner caking or crusting. The slider or drawer member preferably forms the only laterally moving component of the refill adapter. This particular lateral movement is provided in an area which is isolated and free from toner.

In a preferred embodiment, the slider or drawer member comprises a handle to allow convenient manual operation thereof. Furthermore, the lateral movement of the slider or drawer member in a direction generally normal to the movement axis of the second closure member is preferably substantially horizontal. In this way, the slider or drawer member provides for convenient operation of the refill adapter by retracting and extending the slider in a generally horizontal direction and the toner bottle is inverted in the insertion area for optimum flow of the toner into the reservoir under gravity.

In a preferred embodiment, the slider or drawer member can be locked against movement in the non-operating state via a locking means. The locking means is preferably configured to be unlocked or released by insertion of a refill bottle closure into the insertion area. In this regard, the locking means could comprise a resiliently biased arm or catch, which is configured and arranged to be engaged by the closure and pushed out of a locked position into an unlocked position by the closure when the closure is inserted in the insertion area.

In a preferred embodiment, the refill adapter further comprises a platform disposed in the base and movable along the said axis. The second sealing part is attached to the platform, and the platform is configured to close the reservoir opening in the non-operating state and/or when the closure is in the closed position. In particular, the platform comprises a recess in which the second sealing part is attached, such that the recess defines the shape of the second sealing part in the area where the sealing device cooperates with the support element in the non-operating state and/or with the second closure member in the operating state. The platform therefore ensures that the sealing device fits to the support element in the non-operating state and/or to the second closure member in the operating state. Furthermore, the platform forms a rigid closing element for the reservoir opening, which improves safety in use of the toner reservoir when the refill adapter is in the non-operating state.

In a preferred embodiment, the slider or drawer member includes a control device or control mechanism configured to control the axial movement of the platform. Thus, axial movement of both the platform and the second closure member are controlled by means of the slider or drawer member and therefore synchronized. The control mechanism may be formed as guide grooves of the slider or drawer member similar to the translation means, wherein the grooves cooperate with outwardly extending cam or follower elements of the platform. In an alternative embodiment, the platform may comprise the grooves and the slider or drawer member may comprise the cooperating or follower elements.

According to an advantageous embodiment, the control mechanism comprises a translation control section for controlling translation of the sliding movement of the slider into an axial movement of the platform. Therefore, axial movement of the platform is well controlled. Furthermore, the control mechanism comprises a lock control section for locking the platform in a position in which it closes the insertion area, in particular in the non-operating state, and/or for locking the platform in a position in which the second closure member is moved into the open position in the operating state. By means of the locking mechanism, any unwanted movement of the platform is advantageously prevented. Additionally, a similar translation control section may be provided by the translation means of the slider for controlling translation of the sliding movement of the slider into an axial movement of the second closure member. Furthermore, a similar lock control section may be provided by the translation means for locking the second closure member in a position in which it is moved into the open position in the operating state.

According to another aspect, the invention provides a method of coupling a toner bottle to a toner reservoir, especially for re-filling the toner reservoir, in particular by means of a refill adapter according to the present invention, the method comprising the steps of:

- inserting a closure of the toner bottle into an insertion area of a base of a refill adapter;
- holding a first closure member of the closure and moving a second closure member of the closure relative to the first closure member along an axis by means of an opening mechanism, wherein the second closure member is moved from a closed position, in which the second closure member cooperates with the first closure member to close or seal an outlet opening of the closure into an open position, in which the outlet opening is open for dispensing toner from the toner bottle into the toner reservoir; and
- holding a first sealing part of a sealing device and moving a second sealing part of the sealing device relative to the first sealing part together with the second closure member along the axis, whereby the second sealing part contacts the second closure member for isolating an outer region of the closure from an inner region of the closure in contact with toner.

As discussed above, the invention is configured for cooperation of a refill adapter with a closure of a toner, to prevent movement of any component in contact with toner in a direction different from the axis of movement of the second closure member. Thus, the invention provides a method which is configured for safe prevention of creation of toner chips. Since, according to the invention, any lateral movement of components in contact with toner is prevented, toner cannot be trapped. Thus, toner cannot be exposed to any frictional heat caused by lateral movement, which prevents the toner, in particular toner powder, to cake.

Furthermore, the present invention provides a method in which the sealing device ensures a secure isolation of all areas exposed to a user and/or the environment from areas in contact with toner, even during movement of the second closure member. Thus, egress of toner is reliably prevented during all steps of the method and/or at all times before, after or between the steps.

According to a further aspect, the present invention provides a printing system comprising a refill adapter according to any one of the embodiments described above. Additionally or alternatively, the present invention provides a printing system for performing a method of coupling a toner bottle to a toner reservoir as described above.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF EMBODIMENTS

Figure 1:
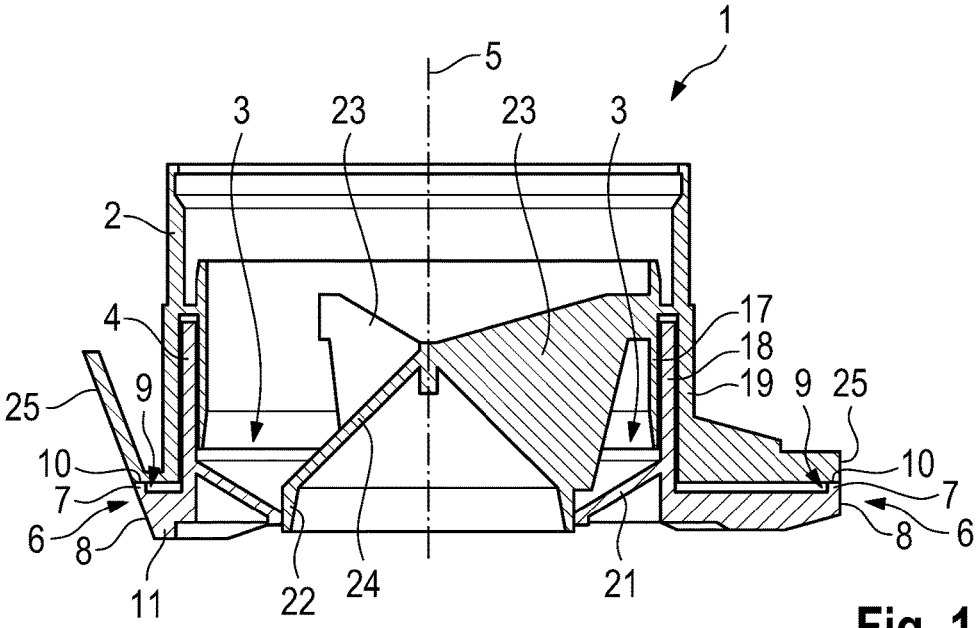
FIG. 1 is a schematic front cross-sectional view of a toner bottle closure according to an embodiment in a closed position.

With reference firstly to FIG. 1 of the drawings, a cross-sectional view of a toner bottle closure is illustrated schematically in a closed position. The toner bottle closure 1 includes a first closure member 2 and a second closure member 4. The first closure member 2 is configured to be fixed to a toner bottle (not shown) and defines an outlet opening 3 for dispensing toner from the toner bottle. The second closure member 4 is attached to the first closure member 2 and is movable relative to the first closure member 2 along an axis 5 between the closed position shown and an open position. In the closed position depicted in FIG. 1, the second closure member 4 cooperates with the first closure member 2 to close the outlet opening 3 against egress of toner.

Furthermore, the second closure member 4 comprises impact damping means 6, which projects in a direction parallel to the axis 5 of movement. The impact damping means 6 is configured to deform plastically for damping a mechanical impact on the toner bottle closure 1. It is therefore configured and arranged to absorb mechanical impact forces acting on the second closure member 4 in the axial direction 5 towards the closed position. The impact damping means 6 acts to prevent a resilient spring-back reaction of the second closure member 4 into the open position in the event of a mechanical impact. In particular, if a toner bottle equipped with the toner bottle closure 1 falls and hits the ground with the toner bottle closure 1, the impact damping means 6 acts to prevent or inhibit the second closure member 4 from springing into the open position, thereby acting to keep the opening 3 safely closed.

Figure 6:
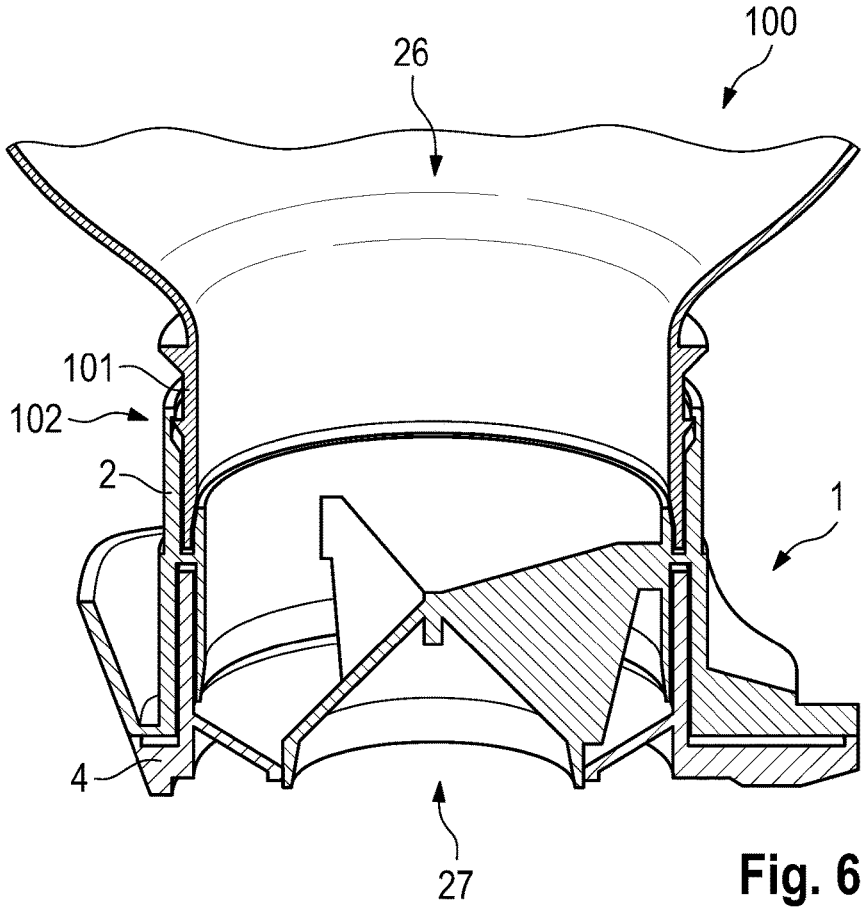
FIG. 6 is a schematic partial perspective cross-sectional view of a toner bottle with a toner bottle closure according to an embodiment.

As shown in FIG. 6, the first closure member 2 is configured to be fixed at a bottle neck 101 of a toner re-fill bottle 100 and is therefore formed as a tubular body. The second closure member 4 is formed as a tubular sleeve with a peripheral wall 18 that is configured for sliding engagement with an internal surface of a peripheral wall 19 of the first closure member 2. In the embodiment shown, the first closure member 2 is internally formed with a skirt 17 that is in sliding engagement with the internal surface of the peripheral wall 18 of the second closure member 4.

Figure 2:
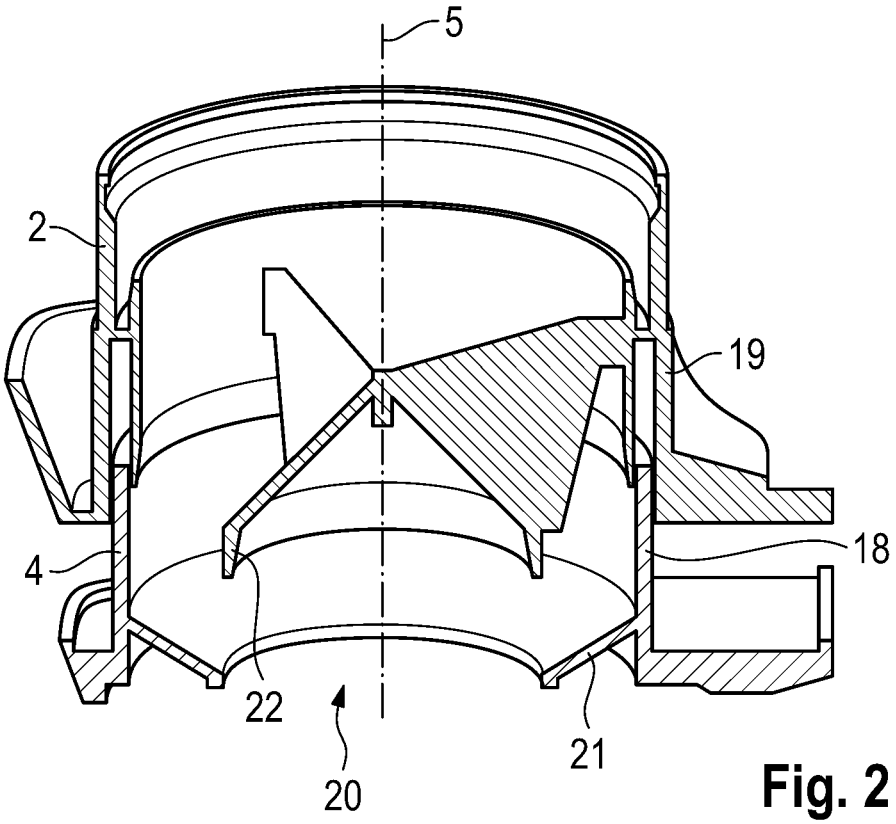
FIG. 2 is a schematic perspective cross-sectional view of the toner bottle closure of FIG. 1 in an open position.

With reference also now to FIG. 2 of the drawings, a cross-sectional view of the toner bottle closure is illustrated schematically in an open position. In the open position, toner can be dispensed through the outlet opening 3. Furthermore, the second closure member 4 defines a flow passage 20 for the toner powder. In the open position of FIG. 2, the outlet opening 3 and the flow passage 20 are coaxial and connected to one another so that toner powder from the bottle may flow there-through in an outflow direction from the first closure member 2 to the second closure member 4. At its lower end, the second closure member 4 has a narrowed funnel-shaped wall part 21 that restricts the cross-section of the flow passage 20.

In the closed position shown in FIG. 1, the flow passage 20 is closed or sealed by a cylindrical central member 22 that is disposed centrally in the outlet opening 3 and is fixed in position by radial spokes 23 connecting a wall of the central member 22 to the peripheral wall 19 of the first closure member 2. The radial spokes 22 divide the outlet opening 3 into a plurality of sector-shaped openings through which the toner, in particular toner particles or powder, may pass.

Furthermore, the cylindrical central member has a cone shaped upper region 24. The cone shape of the upper region 24 closes the cylindrical shape in a direction towards the toner bottle 100 and provides for a smooth and constant flow and for equal distribution of toner to all sectors of the outlet opening 3. In the condition shown in FIG. 1, which is the closed position of the closure 1, the bottom end of the central member 22 is flush with the flow passage 20 and is precisely fitted in the flow passage 20, so that no toner may pass there-through.

The second closure member 4 includes a force transfer element 11 which projects from the second closure member in direction generally away from the first closure member 2. The force transfer element 11 is configured to transfer a force or load of a mechanical impact directly to the impact damping means 6. Thus, the force transfer element 11 projects in the axial direction beyond any part of the first closure member 2 or any other part of second closure member 4, and especially beyond the flow passage 20 and cylindrical central member 22. In the embodiment shown, the force transfer element 11 is formed as a projecting rim of the closure member 4 which extends generally parallel to the impact damping means 6.

In order to open the toner bottle closure 1, the second closure member 4 is moved axially downwardly relative to the first closure member 2, as shown in FIG. 2. As a result, the central member 22 is withdrawn from the flow passage 20, so that toner may flow out through the outlet opening 3 and the flow passage 20.

During the axial downward movement of the second closure member 4 relative to the first closure member 2, the peripheral wall 18 of the second closure member 4 slides along the internal surface of the outer peripheral wall 19 of the first closure member 2. However, because the internal surface of the peripheral wall 19 of the first closure member 2 was covered by the peripheral wall 18 of the second closure member 4 and/or by the skirt 17, no toner, particularly no toner powder, can adhere to that wall. Toner, any particularly toner powder, may adhere only to the internal surface of the lower part of the peripheral wall 18 of the second closure member 4 which is not covered by the skirt 20.

During opening movement of the second closure member 4, this member moves axially downwards, i.e. in the outflow direction of the toner, so that an increasingly larger portion of the internal surface of the peripheral wall 18 becomes exposed to the toner. However, provided a movement of the second closure member 4 is not reversed, none of these surface areas of the second closure member 4 will come into sliding engagement with a part of the first closure member 2 again. As a result, the toner may smoothly flow out of the bottle without being exposed to any frictional heat. In this way, the especially fine toner powder is not caused to cake or to form larger solid chips. Thus, when a toner bottle with the closure 1 is placed on top of a refill opening of a toner reservoir of a copier or printer device, the toner, and particularly toner powder, exiting from the flow passage 20 will not contain any chips that could deteriorate the printing properties of the toner.

When the second closure member 2 is moved axially upwards again to the closed position, any remnants of toner that stick to the internal wall of the second closure member 2 may be stripped-off by the skirt 17 and fall down towards the funnel shaped wall part 21. However, as the inclination of this wall part 21 is relatively small, the toner removed from the peripheral wall (and any chips that may possibly be formed) will not reach the flow passage 20 before it is closed again by the central member 22. It will further be noted that the wall part 21 is relatively thin, so that the edge surface of the flow passage 20 has only a very small surface area to which only very minute amounts of toner may adhere. Consequently, the amount of toner that may exit the closure 1 when it is closed again is extremely small. In a similar manner, the central member 22 is configured as a thin-walled hollow cylinder (closed conically at the top end), so that practically no toner powder will adhere to the bottom end of the central member 22 either.

Figure 3A:
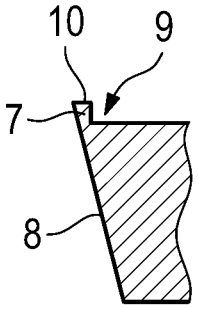
FIG. 3A is a schematic cross-sectional view of part of the toner bottle closure showing an impact damping means in a non-deformed state.

Referring now to FIG. 3A of the drawings, a schematic cross-sectional view of the impact damping means 6 and particularly a deformable portion 7 thereof is shown. The impact damping means 6 comprises the deformable portion 7 for damping mechanical impact by means of a predefined plastic deformation. The deformable portion 7 is formed as an elongate lip. The lip 7 extends along an outer periphery 8 of the second closure member 4 and is fixed thereto along an edge region 9 of the lip 7 and projects to a free edge region 10. The free edge region 10 of the lip 7 engages with the first closure member 2, particularly in a region of an outer periphery 25 thereof, in the closed position as shown in FIG. 1.

Figure 3B:
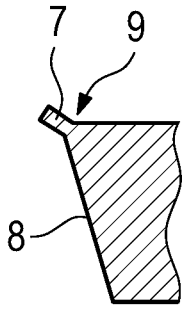
FIG. 3B is a schematic cross-sectional view of part of the toner bottle closure showing the impact damping means in a plastically deformed state.

FIG. 3B schematically illustrates the deformable portion 7 in a plastically deformed state. The deformable portion 7 is configured to deform plastically through bending of the lip 7 about an axis substantially parallel to the fixed edge region 9 in case of a mechanical impact, as illustrated in FIG. 3B.

Figure 4:
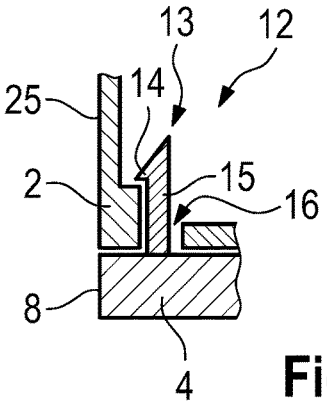
FIG. 4 is a schematic cross-sectional view of part of the toner bottle closure showing a guide.

Referring now to FIG. 4 of the drawings, a schematic cross-sectional view of a guide 13 is illustrated. The guide 13 forms part of a rotation prevention means 12 for preventing rotation of the second closure member 4 about the movement axis 5 movement relative to the first closure member 2. The guide 13 is thus configured or designed to allow only movement of the second closure member 4 relative to the first closure member 2 in a direction parallel to the axis 5. This way, rotation of the second closure member 4 relative to the first closure member 2 is prevented, and thereby also rotational friction. The guide 13 includes a pin or peg element 15 which projects from the second closure member 4 in the axial direction towards the first closure member 2. Furthermore, the guide 13 includes a guide opening 16 in the first closure member 2, through which the pin or peg element 15 extends. The pin or peg element 15 of the guide 13 includes a stop member 14 configured as an engagement hook formed integrally at an end region thereof for engaging a rim or edge of the guide opening 16, through which the pin or peg element 15 extends. The engagement hook therefore limits or defines an extent of the axial movement of the second closure member 4 relative to the first closure member 2 in the open position of FIG. 2.

Figure 5:
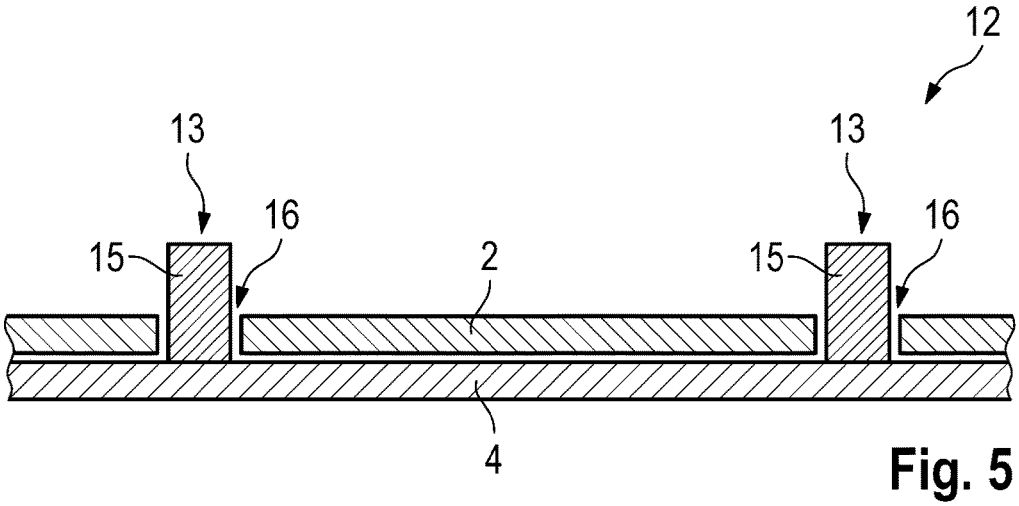
FIG. 5 is a schematic lengthwise cross-sectional view of part of the toner bottle closure showing two parallel guides.

Referring to FIG. 5 of the drawings, a lengthwise schematic cross-sectional view of two parallel guides 13 is illustrated. The shown cross-sectional plane is parallel to the outer periphery 8 of the second closure member 4, which outer periphery 8 has a four sided shape, preferably with two long sides and two shorter sides as well as two rounded corners and two sharp corners. Further, the cross-sectional plane is also parallel to the outer periphery 25 of the first closure member 2, which has a shape that continues the shape of the outer periphery 8 of the second closure member 4. The cross-sectional plane therefore may cut or be tangent to peripheral walls 18 and 19 (not shown in FIG. 5). A pair of guides 13 as depicted in FIG. 5 may be provided on both long sides of the outer peripheries 8, 25. Thus, a total number of four guides 13 may be provided. Preferably, one guide 13 is positioned in each corner of the outer periphery 8, 25.

With reference to FIG. 6 of the drawings, a schematic partial cross-sectional view of a toner bottle 100 is illustrated. The toner bottle 100 includes a bottle neck 101 shown in an inverted state with the bottle neck 101 facing downward. It will be understood that the term "toner bottle" as used here designates any type of vessel or container that is capable of accommodating powdery or liquid toner.

The toner bottle 100 is closed by the closure 1. Thus, the first closure member 2 is secured at the bottle neck 101 of the toner bottle 10 with an engaging flange connection 102. Accordingly, the closure has an outer region 27, which is isolated from toner, and an inner region 26, which is in contact with toner. Should the toner bottle 100 fall and hit the ground at the toner bottle closure 1, an impact will be imparted directly to the force transfer element 11. A load or force of the impact will thus be directly transferred to the impact damping means 6, such that a predefined flux of forces is provided.

Figure 7:
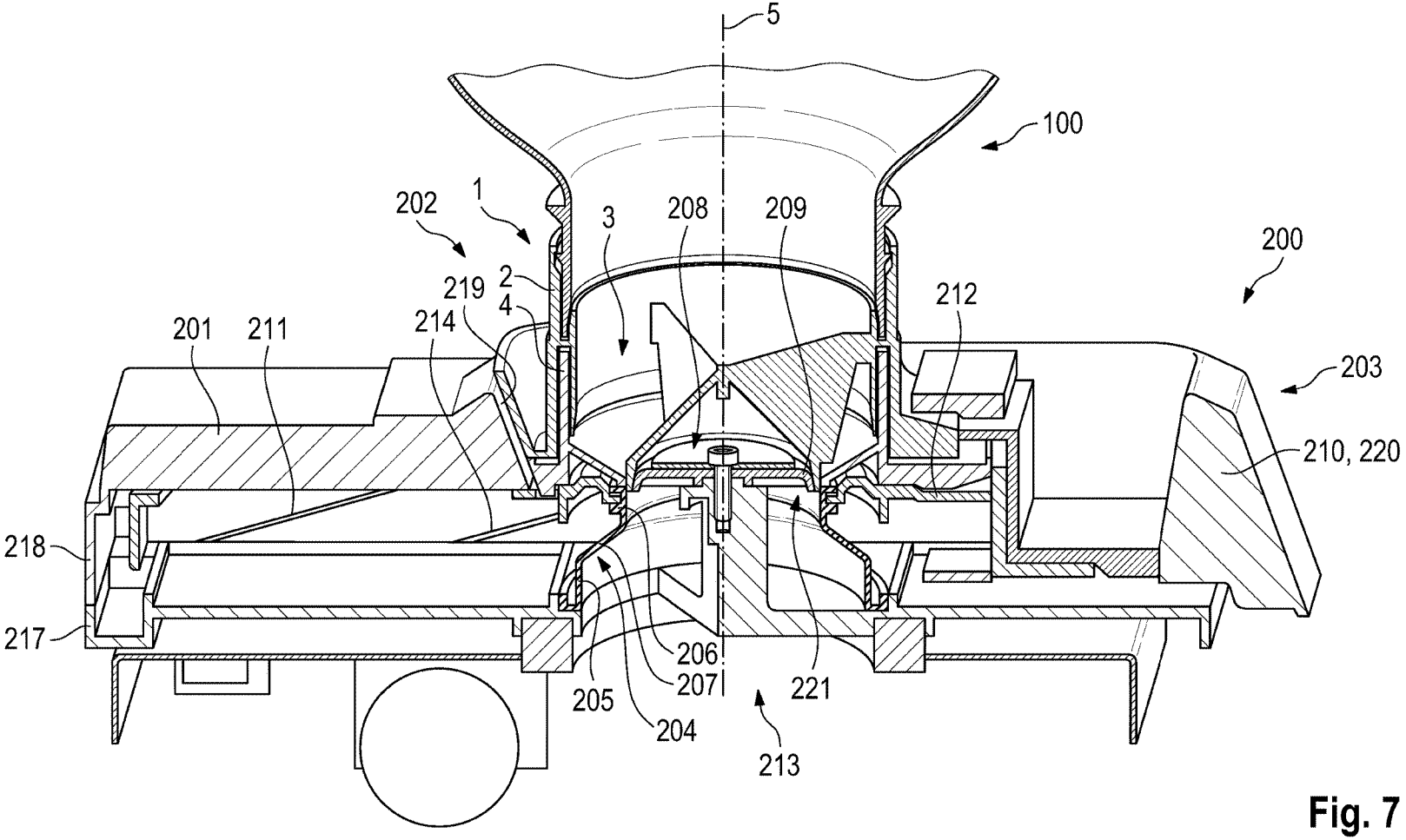
FIG. 7 is a schematic cross-sectional view of a refill adapter and toner bottle closure in a closed position according to an embodiment.

Referring to FIG. 7 of the drawings, a refill adapter 200 and a toner bottle 100 with a closure 1 are illustrated schematically in a closed position. The toner bottle closure 1 is provided with the construction according to FIGS. 1 to 6.

The refill adapter 200 is positioned at a reservoir opening 213 of a toner reservoir (not shown). The refill adapter comprises a base 201 having an insertion area 202 for receiving the closure 1 inserted therein. An opening mechanism 203 is provided for opening the closure 1. The base comprises a base plate 217 and a socket plate 218 forming an upper surface of the refill adapter 200 including part of the insertion area 202, which is formed in a socket-like manner. The shape of the insertion area 202 corresponds to the outer shape of the closure 1.

To refill the toner reservoir, the toner bottle 100 is inverted and the closure 1 of the bottle is inserted into the insertion area 202 so that the toner bottle 100 with the closure 1 may be coupled to the refill adapter 200. The opening mechanism 203 is configured to hold the first closure member 2 of the closure 1 and to move the second closure member 4 of the closure 1 in the axial direction relative to the first closure member 2.

For holding the first closure member 2, the refill adapter 200 comprises a support element 208 provided on the base 201. The support element 208 is fixed to the base plate 217 and is located centrally within the insertion area 201. The support element 208 is formed with a round or disc-shaped flange configured to engage the central member 22 and thereby to support the first closure member 2 when, as shown in FIG. 7, the closure 1 is inserted into the insertion area 202. Additional to the support element 208, the socket plate 218 supports the first closure member 2 with a socket-shaped surface 219 forming a rim of the insertion area 202. When the opening mechanism 203 moves the second closure member 4 along the axis 5 into the open position, toner can be dispensed from the toner bottle 100 through the outlet opening 3 into the toner reservoir.

Figure 8:
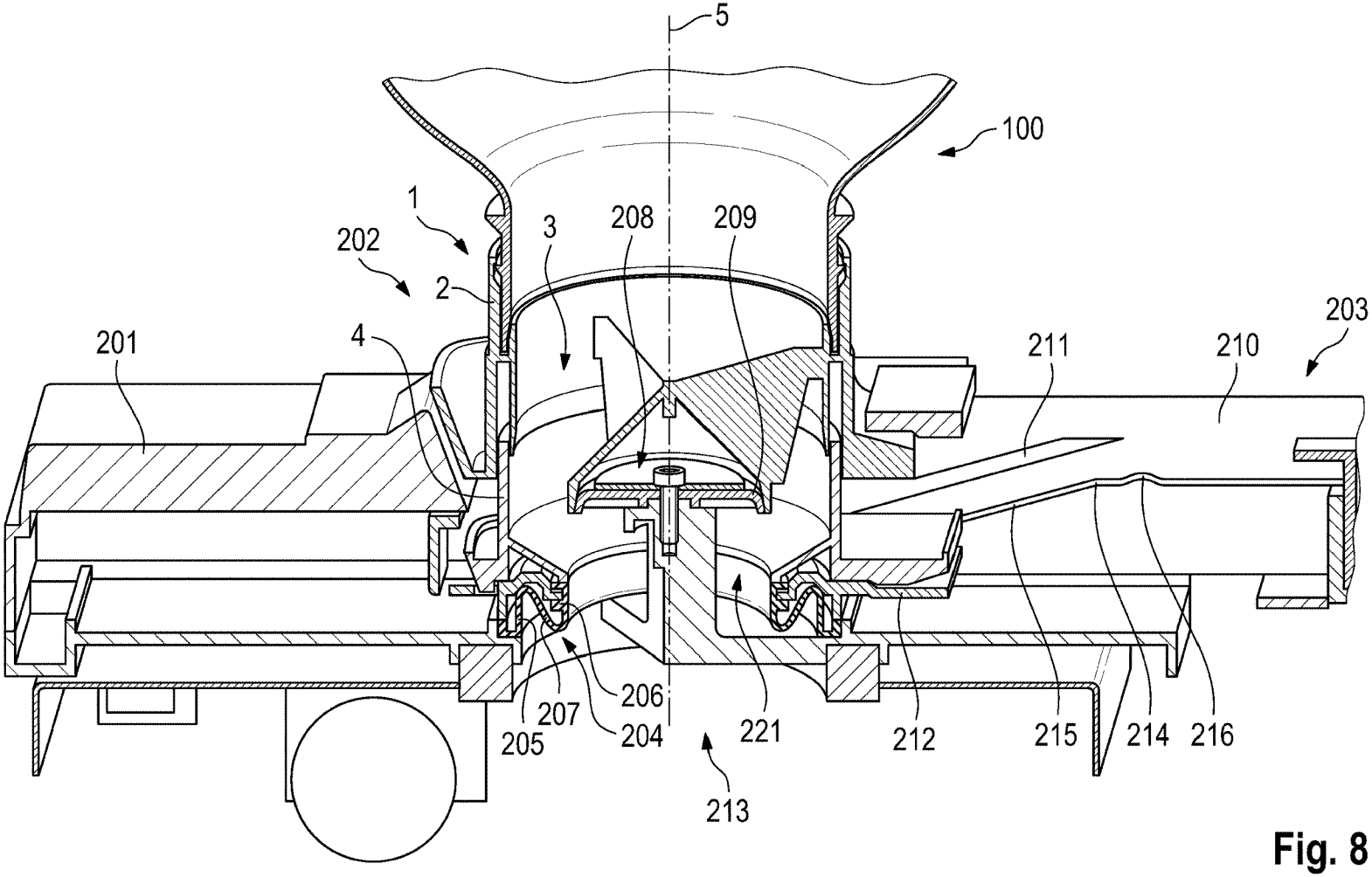
FIG. 8 is a schematic cross-sectional view of a refill adapter and toner bottle closure in an open position according to an embodiment.

With reference now to FIG. 8 of the drawings, the refill adapter 200 and the toner bottle closure 1 are illustrated schematically in the open position. The refill adapter 200 includes a sealing device 204 for isolating the outer region 27 of the closure from the inner region 26 of the closure, which is in contact with toner, in the open position. The sealing device 204 comprises a flexible sealing membrane which can be seen to have three parts; including a first sealing part 205, which is fixed to the base plate 217 of the base 201, and a second sealing part 206, which engages the funnel-shaped wall part 21 around the flow passage 20 and which is movable relative to the first sealing part 205. The second sealing part 206 is thus configured to move with the second closure member 4 along the axis 5 and thereby to remain in contact with the second closure member 4. The flexible sealing membrane further comprises a third sealing part 207 which interconnects the first sealing part 205 and the second sealing part 206. It is desirably configured to impart a resilient bias to the second sealing part 206 to press and seal against the second closure member 4. The third sealing part 207 may therefore be provided in the form of an annular elastic or resilient spring, having a frusto-conical shape extending axially with an oblique angle between the first sealing part 205 and the second sealing part 206. The first and second sealing parts 205, 206 are typically also annular. The first sealing part 205 has a larger diameter than the second sealing part 206 and the third sealing part 207. Thus, in the closed state of the closure 1, when the third sealing part 207 is extended, as shown in FIG. 7, the sealing device 204 has a shape of an outwardly tapering or widening tube.

To move the second closure member 4, the opening mechanism 203 comprises a slider 210 disposed in the base 201. The slider 210 is movable in a direction that is approximately normal to the movement axis 5 of the second closure member 4. It can be slid between a first position, in which it is retracted into the base 201, and a second position, in which it is extended out of the base 201. The slider 210 includes translation means 211 configured to translate the sliding movement of the slider 210 into axial movement of the second closure member 4. The translation means 211 include guide grooves which are engaged by cams or followers (not shown) that project outwardly from a base part or outer periphery 8 of the second closure member 4. As the cams or followers travel in the grooves during sliding movement the of the slider 210 between the first retracted position and the second extended position, the grooves translate that movement of the slider 210 into an axial movement of the second closure member 4. The slider 210 also entrains the second closure member 4 by means of the grooves 211, when the slider is moved from the first position into the second position. As a result, the closure 1 inserted in the insertion area 202 can be manipulated between its closed position and open position by extending and retracting the slider 210.

The slider 210 forms the only laterally moving component of the refill adapter 200. The sealing device 205 in cooperation with the closure 1 isolates the area of the slider 210 from the inner region 26 of the closure 1. As a result, toner cannot be trapped between the slider and the base. The slider 210 typically further comprises a handle 220 to allow convenient manual activation of the slider 210. Additionally, the slider 210 may include a control mechanism 214 configured to control the axial movement of a platform 212.

The platform 212 is disposed in the base 201 and is movable along the axis 5. It is configured to close the reservoir opening 213 in the non-operating state and/or when (in the operating state) the closure is in the closed position. The platform 212 may therefore form a rigid closing element for the reservoir opening 213. In this regard, the platform 212 may have a round or circular recess 221 in which the second sealing part 206 is accommodated and attached to the platform 212. The round recess therefore defines the shape of the second sealing part 206. To close the reservoir opening 213, the round recess 221 of the platform 212 cooperates with round support element 208, with the second sealing part 206 there-between. The sealing device 205 and the support element 208 are therefore configured to fit together for closing the reservoir opening 213 of the toner reservoir in a sealed manner.

In the non-operating state of the refill adapter 200, when the insertion area 202 is free of any closure 1, a closed surface is formed by the platform 212, the support element 208 and the socket plate 218. In the operating state of the adapter 200, when a closure 1 is in the insertion area 202, the platform 212 cooperates with the second closure member 4 in that the second sealing part 206 contacts the second closure member 4. The platform 212 ensures that the form and position of the second sealing part 206 fits to the support element 208 in the non-operating state and to the second closure member 4 in the operating state. Axial movement of the platform 212 and the second closure member 4 are both controlled by means of the slider 210 and therefore synchronized.

A control mechanism 214 of the slider 210 is also formed by guide grooves which are engaged by cams or followers (not shown) that project outwardly from the platform 212. The control mechanism 214 thus also comprises a translation control section 215 for controlling translation of the sliding movement of the slider 210 into an axial movement of the platform by means of an incline of the guide grooves. Furthermore, the control mechanism 214 comprises a lock control section 216 for locking the platform 212 in a position in which it closes the insertion area 202, in particular in the non-operating state. The locking mechanism 216 is formed by a wave of the guide grooves, which elastically compresses the cams and thus provides for increased frictional resistance to be overcome by the slider 210 in order to move. Unwanted movement of the slider 210 and the platform 212 is therefore advantageously prevented.

The support element 208 comprises a flexible fitting part 209 at an outer edge thereof. The flexible fitting part 209 has multiple different functions in the different states of the refill adapter 200: In the non-operating state or when (in the operating state) the closure 1 is in the closed position, the flexible fitting part 209 is designed or configured for contacting the second sealing part 206 for sealing the reservoir opening 213. When, in the operating state, the closure 1 is in the open position, the flexible fitting part 209 is configured for contacting the end portion of the central member 22 of the first closure member 2 for isolating the central member 22 from the inner region 26 of the closure 1. This way, the central member 22 is kept clean from toner.

As a result, all parts of the closure 1 which could be accessible for a user when the closure 1 is removed from the insertion area 202 are isolated from the inner region 26 in contact with toner. This isolation is provided in the open position or in any intermediate position of the closure 1. Therefore, a refill process can be conducted by a user without any contact to toner, even if the outer region 27 of the closure 1 is touched after release of the closure 1 from the insertion area 202.

For releasing the closure 1 from the insertion area 202 when the refill process has been completed, the slider 210 is retracted back into the base (towards the left side in FIG. 8) so that the second closure member 4, the second sealing part 206 and the platform 212 are moved back into the closed position as shown in FIG. 7. The closure 1 and the reservoir opening 213 are thereby closed. None of the parts of the refill adapter 200 in contact with toner is exposed to frictional forces until the second sealing part 206 contacts the support element 208 and the reservoir opening 213 is closed, as only parts which are not in contact with toner are in sliding or moving contact. Thus, no toner crusting or caking occurs due to frictional forces when the opening mechanism 203 of the refill adapter 200 is manipulated. Finally, after refilling the reservoir, the toner bottle 100 with the closure 1 may be detached from the insertion area 202 and disposed of or recycled.

Although specific embodiments of the invention are illustrated and described herein, it will be appreciated by those of ordinary skill in the art that a variety of alternate and/or equivalent implementations exist.

In the embodiment that has been described here, for example, the second closure member 4 is lowered in order to open the outlet opening 3. Of course, a modified embodiment is also possible wherein, rather than descending the second closure member 4, the slider 210 controls a lift movement of the first closure member 2 and the toner bottle 100. In this case, for example, the support element 208 and the first closure member could be moved axially upwards by the slider 210 into an open position. Furthermore, a combination of both, a lowering of the second closure member 4 and lifting of the first closure member 2, is possible.

It will be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It may also be understood, that the refill adapter for coupling a closure of a (toner) bottle to a (toner) reservoir, as disclosed and claimed in the present application may also be suitable for being used in combination with bottles containing other powder like substances or liquids, such as ink compositions.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 toner bottle closure
2 first closure member
3 outlet opening
4 second closure member
5 axis
6 impact damping means
7 lip
8 outer periphery
9 fixed edge region
10 free edge region
11 force transfer element
12 rotation prevention means
13 guide
14 stop member
15 pin or peg element
16 guide opening
17 skirt
18 peripheral wall
19 peripheral wall
20 flow passage
21 wall part
22 central member
23 spoke
24 top
25 outer periphery
26 inner region
27 outer region
100 toner bottle
101 bottle neck
102 flange connection
200 refill adapter
201 base
202 insertion area
203 opening mechanism
204 sealing device
205 first sealing part
206 second sealing part
207 third sealing part
208 support element
209 fitting part
210 slider
211 translation means
212 platform
213 reservoir opening
214 control mechanism
215 translation control section
216 lock control section
217 base plate
218 socket plate
219 socket-shaped surface
220 handle
221 recess

The invention claimed is:

1. A refill adapter for coupling a closure of a toner bottle to a toner reservoir, the refill adapter comprising:

a base having an insertion area for receiving the closure inserted therein and an opening mechanism for opening the closure, wherein the opening mechanism is configured to hold a first closure member of the closure and to move a second closure member of the closure relative to the first closure member along an axis between a closed position, in which the second closure member cooperates with the first closure member to close or seal an outlet opening of the closure, and an open position for dispensing toner from the toner bottle through the outlet opening into the toner reservoir; and a sealing device for preventing toner leakage during operation of the opening mechanism, the sealing device comprising a first sealing part, the first sealing part being fixed to the base, and a second sealing part, the second sealing part being movable relative to the first sealing part, wherein the second sealing part is configured to be moved together with the second closure member along the axis and to thereby contact the second closure member for isolating an outer region of the closure from an inner region of the closure, the inner region of the closure being in contact with toner.

2. The refill adapter according to claim 1, wherein the second sealing part is resiliently biased to press and seal against the second closure member.

3. The refill adapter according to claim 2, wherein the sealing device further comprises a third sealing part, the third sealing part interconnecting the first sealing part and the second sealing part and/or being configured to provide the resilient bias of the second sealing part.

4. The refill adapter according to claim 1, further comprising a support element provided on the base and positioned in the insertion area, the support element being configured to engage a facing end portion of the first closure member and to support the first closure member when, in operation, the closure is inserted into the insertion area.

5. The refill adapter according to claim 4, wherein in an operating state of the refill adapter, when a closure is inserted in the insertion area, the support element engages the facing end portion of the first closure member, and wherein, in a non-operating state, when the insertion area is free of the closure, the support element forms part of a closed surface of the insertion area.

6. The refill adapter according to claim 5, wherein the sealing device and the support element are configured to fit together for closing a reservoir opening of the toner reservoir in the non-operating state and/or when the closure is in the closed position.

7. The refill adapter according to claim 6, wherein the support element comprises, at least at a periphery or an outer edge thereof, a flexible fitting part.

8. The refill adapter according to claim 7, wherein the flexible fitting part is configured for contacting the second sealing part for sealing the reservoir opening in the non-operating state and/or when the closure is in the closed position.

9. The refill adapter according to claim 7, wherein the flexible fitting part is configured for contacting the facing end portion of the first closure member for isolating the facing end portion from the inner region of the closure in the operating state and/or when the closure is in the open position.

10. The refill adapter according to claim 1, wherein the opening mechanism comprises a slider disposed in the base and movable in a direction normal to the axis of movement of the second closure member between a first position, in which the slider is retracted into the base, and a second position, in which the slider is, at least partially, extended out of the base, wherein the slider is configured to entrain the second closure member when the slider is moved from the first position to the second position, and wherein the slider comprises a translation mechanism configured to translate movement of the slider into an axial movement of the second closure member.

11. The refill adapter according to claim 10, further comprising a platform disposed in the base and movable along the axis, wherein the second sealing part is attached to the platform, and wherein the platform is configured to close the reservoir opening in the non-operating state and/or when the closure is in the closed position.

12. The refill adapter according to claim 11, wherein the slider further comprises a control mechanism configured to control the axial movement of the platform.

13. The refill adapter according to claim 12, wherein the control mechanism comprises a translation control section for controlling translation of the sliding movement of the slider into an axial movement of the platform and wherein the control mechanism further comprises a lock control section for locking the platform in a position in which the platform closes the insertion area, and/or for locking the platform in a position in which the second closure member is moved into the open position in the operating state.

14. A method of coupling a toner bottle to a toner reservoir, by means of the refill adapter according to claim 1, the method comprising the steps of:

inserting the closure of the toner bottle into the insertion area of the base of the refill adapter;

holding the first closure member of the closure and moving the second closure member of the closure relative to the first closure member along the axis by means of the opening mechanism, wherein the second closure member is moved from the closed position, in which the second closure member cooperates with the first closure member to close or seal the outlet opening of the closure into the open position, in which the outlet opening is open for dispensing toner from the toner bottle into the toner reservoir; and holding the first sealing part of the sealing device and moving the second sealing part of the sealing device relative to the first sealing part together with the second closure member along the axis, whereby the second sealing part contacts the second closure member for isolating the outer region of the closure from the inner region of the closure in contact with the toner.

15. A printing system which comprises a refill adapter configured to perform the method of coupling a toner bottle to a toner reservoir according to claim 14.

16. The refill adapter according to claim 1, further comprising a support element provided on the base and positioned centrally in the insertion area, the support element being configured to engage a facing end portion of a central member of the first closure member and to support the first closure member when, in operation, the closure is inserted into the insertion area.

17. The refill adapter according to claim 2, further comprising a support element provided on the base and positioned centrally in the insertion area, the support element being configured to engage a facing end portion of a central member of the first closure member and to support the first closure member when, in operation, the closure is inserted into the insertion area.

18. The refill adapter according to claim 3, further comprising a support element provided on the base and positioned centrally in the insertion area, the support element being configured to engage a facing end portion of a central member of the first closure member and to support the first closure member when, in operation, the closure is inserted into the insertion area.

19. The refill adapter according to claim 8, wherein the flexible fitting part is configured for contacting the facing end portion of the first closure member for isolating the facing end portion from the inner region of the closure in the operating state and/or when the closure is in the open position.

20. The refill adapter according to claim 2, wherein the opening mechanism comprises a slider disposed in the base and movable in a direction normal to the axis of movement of the second closure member between a first position, in which the slider is retracted into the base, and a second position, in which the slider is, at least partially, extended out of the base, wherein the slider is configured to entrain the second closure member when the slider is moved from the first position to the second position, and wherein the slider comprises a translation mechanism configured to translate movement of the slider into an axial movement of the second closure member.

* * * * *